United States Patent [19]

Lutz

[11] Patent Number: 4,493,347

[45] Date of Patent: Jan. 15, 1985

[54] WEFT INSERTION DEVICE FOR A BAND-GRIPPER WEAVING MACHINE

[75] Inventor: Friedrich Lutz, Durnten, Switzerland

[73] Assignee: Ruti Machinery Works, Ltd., Ruti, Switzerland

[21] Appl. No.: 416,261

[22] Filed: Sep. 9, 1982

[30] Foreign Application Priority Data

Oct. 14, 1981 [CH] Switzerland ..... 6559/81

[51] Int. Cl.[3] ..... D03D 47/00

[52] U.S. Cl. ..... 139/449; 74/89.2

[58] Field of Search ..... 139/449, 429, 440, 443, 139/446; 74/89.2, 89.21, 89.22

[56] References Cited

U.S. PATENT DOCUMENTS

| | | | |
|---|---|---|---|
| 949,706 | 2/1910 | Humphries | 139/449 |
| 3,625,077 | 12/1971 | Bernard et al. | 74/89.21 |
| 4,130,143 | 12/1978 | Smutny | 139/449 |
| 4,274,449 | 6/1981 | Freisler et al. | 139/449 |

FOREIGN PATENT DOCUMENTS

| | | | |
|---|---|---|---|
| 2502692 | 9/1975 | Fed. Rep. of Germany | 139/449 |
| 2941840 | 4/1980 | Fed. Rep. of Germany | 139/449 |
| 59517 | 12/1967 | German Democratic Rep. | 139/449 |

*Primary Examiner*—James Kee Chi

*Attorney, Agent, or Firm*—Burns, Doane, Swecker & Mathis

[57] ABSTRACT

The present invention relates to a weft insertion device for use on a band-gripper weaving machine. The device has a driven, rotationally oscillating band wheel having a flexible insertion band including a gripper head. The band executes an oscillating movement transversely to the warp shed as the band unwinds from the winds onto the circumference of the band wheel. The circumference of the band wheel is smaller than the maximum excursion of the gripper head. The insertion band is wound around the circumference of the band wheel to the extent of more than 360° when the gripper head is in the position in which the head is fully and maximally withdrawn from the warp shed. In this way, the diameter of the band wheel can be kept small. This small diameter permits operation at high rotational speeds and also renders the band wheel less expensive. This is particularly advantageous when the machine is wide. Further, the contribution to total machine width made by the band wheels is less than under the prior art, and additionally the height of the machine does not need to be increased with a corresponding increase in machine width.

11 Claims, 6 Drawing Figures

WEFT INSERTION DEVICE FOR A BAND-GRIPPER WEAVING MACHINE

BACKGROUND AND SUMMARY OF THE PRESENT INVENTION

The present invention relates to a weft insertion device for use on a band-gripper weaving machine. The weft insertion device comprises a driven, rotationally oscillating band wheel cooperating with a flexible insertion band having a gripper head and executing an oscillating movement into and out of the warp shed as it correspondingly unwinds from the winds onto the circumference of the band wheel. A guide means is provided for preventing the insertion band from separating from the outside circumference of the band wheel. The guide means is in the form of a cable of appropriate length which rests or presses against the outside of the insertion band. Both ends of the cable are anchored to the band wheel.

In a device of this type as disclosed in U.S. Pat. No. 4,274,449, the insertion band is wound around the circumference of the band wheel to the extent of about 300°–330° when the gripper head is in the position in which the head is fully and maximally withdrawn from the warp shed. The distance around the entire circumference of the band wheel is thus always a little greater than the maximum amplitude or excursion of the gripper head. The excursion is in turn directly related to the width of the machine.

Each time the direction of rotation of the band wheel is changed, the band wheel must be stopped and then accelerated again. In the charging process a moment of inertia of the mass of the band wheel must be overcome. Since the diameter and mass of the band wheel increase as the width of the weaving machine increases, the moment of inertia of the band wheel increases as well, thus limiting the speed of the weaving machine. Accordingly, for some time there have been ongoing efforts to substitute lighter structures for the band wheels which were originally in the form of cast wheels with spokes.

The lighter-construction wheels have a disc-like wheel body which is directly connected to the hub and has a honeycomb structure. The material used is either a light metal or a plastic. While these band wheels have generally had successful performance in practice, they are relatively expensive to manufacture. In addition there is the possibility that as weaving machines become substantially larger than those commonly in use today there may be problems related to the rigidity of present band wheels.

Accordingly, an object of the present invention is a refinement of a device of the type described initially above, whereby even with a very wide weaving machine the moment of inertia of the band wheels can be kept as small as possible. Also the rigidity of the band wheels may be maintained as high as possible without increasing the cost of manufacture.

These objects and others are achieved according to the present invention by a band wheel having a circumference which is smaller than the maximum excursion of the gripper head. Also, the insertion band is wound around the circumference of the band wheel to the extent of more than 360° when the gripper head is in the position in which the head is fully and maximally withdrawn from the warp shed. Further, a cable rests or presses against the entire length of the insertion band which is wound onto the band wheel.

The invention deviates from the former approach of attempting to maintain high rotational speeds on wider machines by improving the design of the band wheels. Instead, it is proposed by the present invention to have an overlap in the winding of the insertion band around the circumference of the band wheel. By this technique, the diameter of the band wheel can be kept small, so that a wider machine will not entail either higher band wheel manufacturing costs or problems stemming from the inadequate rigidity of a larger diameter band wheel. The use of a band wheel with a lower moment of inertia also permits a higher rotational speed as well as a simplification and reduction in cost of the band wheel drive.

It should also be noted that with prior art devices wherewith the insertion band is wound around the band wheel to the extent of less than the total circumference of the wheel, the increased band wheel diameter accompanying increased machine width eventually leads to a condition where the necessary band wheel is too large for the machine. In other words, the machine is too short vertically to accommodate the band wheel. Also, an increased band wheel diameter itself adds to the overall width of the machine. Thus, the present invention affords significant dimensional advantages over the prior art. For example, the present invention limits the additional machine width occasioned by the band wheels when the basic machine width is increased. Further, the present invention permits the machine to be widened substantially without the machine having to be increased in height as well.

BRIEF DESCRIPTION OF THE DRAWINGS

A preferred embodiment of the present invention will be described in greater detail in the following description with reference to the accompanying drawings, wherein like members bear like reference numerals and wherein.

DETAILED DESCRIPTION OF THE PREFERRED EMBODIMENT

Figure 1:
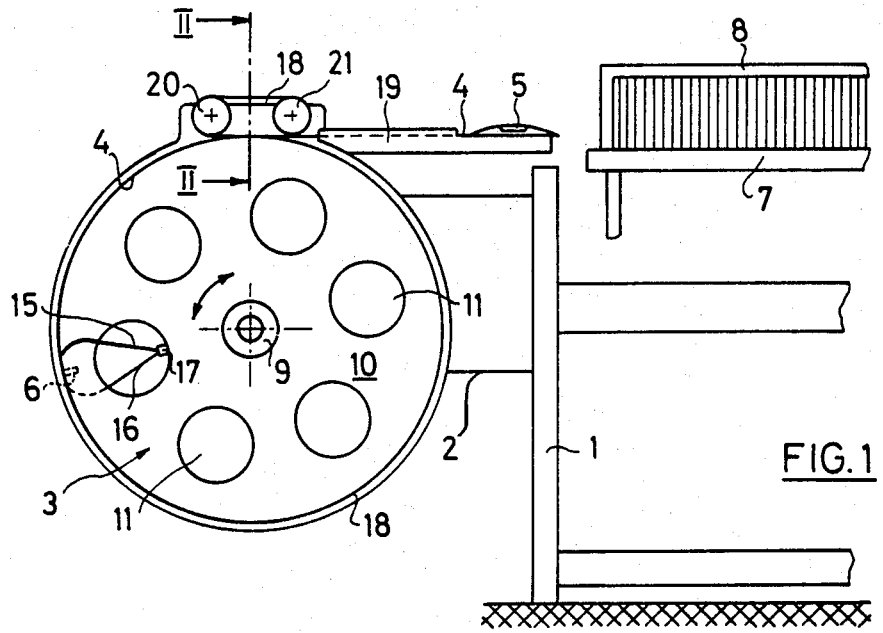
FIG. 1 is a schematic front view of parts of a band-gripper weaving machine which parts are necessary for an understanding of the invention.

With reference to FIG. 1, a portion of a band-gripper weaving machine of known construction includes on the left and right sides of a machine frame 1 respective base plates 2 each serving as mounting supports of a respective band wheel 3. Each of the band wheels 3 is covered by a removable cover (not shown). In FIG. 1, only the left band wheel 3 is shown, with the cover removed. The configuration for the right band wheel is a mirror image of the configuration of the left band wheel. Weft threads are held in a large yarn supply arrangement (not shown) at the right side of the weaving machine, and are fed to a first gripper head which is attached to one end of a flexible insertion band. The gripper head end of the flexible insertion band rests against the rim of the right band wheel, and the other end is connected to said rim. Similarly, a flexible insertion band 4 is attached to the left band wheel 3, and a second gripper head 5 is mounted on a free end of the band 4. The end of the band 4 opposite to the gripper heads is attached to the band wheel 3 by a screw 6.

The band wheels are driven in rotational directions, whereby the two gripper heads are continually moved toward the middle of the warp shed (not shown) and then back out of the shed again. The transfer of the weft thread from the first to the second gripper head 5 is effected in the middle of the warp shed. Thereafter, the weft thread is inserted into the second half of the warp shed from the middle of the shed by the second gripper head 5. After the insertion is completed, the weft thread is beaten-up by a reed 8 which is attached to a batten 7.

With reference to FIG. 1, the gripper head 5, in the illustrated position, is fully and maximally withdrawn from the warp shed. The insertion band 4 is wound around the band wheel 3 to the extent of more than the circumferential distance of the wheel 3 such that the band overlaps itself. The winding is approximately to the angular extent of about 460° around the band wheels whereas in the prior art the winding was only to the angular extent of around 320°. This overlapping of the insertion band 4 by about 100° has enabled a reduction in the diameter of the band wheels 3 by about 25–30%.

The band wheel 3 is of a known construction, preferably comprising a hub 9 and a wheel body 10 mounted at the middle of the hub 9. The wheel body 10 is of a suitable material and includes a plurality of holes 11 circularly aligned. The holes are for reducing the mass of the band wheel 3. A band wheel of this type is described in U.S. Pat. No. 3,987,822 and Swiss Pat. No. 629,859.

The band wheel described in Swiss Pat. No. 629,859 has proven to be particularly suitable. The wheel body 10 (reference numerals from the present drawings) has a disc-shaped part which is comprised of a honeycomb structure in which the cells run parallel to the rotational axis of the band wheel 3 and are open on both sides of the wheel 3. This honeycomb piece, which is made of a light metal or a plastic, is covered on both sides by thin circular discs and at its circumference by a sheet or film. This composite structure of the wheel body 10 (FIG. 2) includes the honeycomb part 12, the side discs 13 and the sheet or film 14 on the circumference.

Since one end of the insertion band 4 is attached to the band wheel 3 by the screw 6, the band 4 is pushed when the gripper head 5 moves into the warp shed (during the unwinding of the insertion band 4), and is pulled when the gripper head 5 is withdrawn from the warp shed (during the winding of the insertion band 4). In the pushing mode, the insertion band 4 is forced away from the circumference of the band wheel 3 during the acceleration phase. In the pulling mode, the insertion band 4 is forced away from the circumference during the deceleration phase. In order to prevent the insertion band 4 from separating from the circumference of the band wheel 3 under these circumstances, a guide element is provided.

In the illustrated embodiment, this guide element is in the form of a cable 18 of appropriate length which has its two ends 15 and 16 anchored to a lug 17 attached to the band wheel 3. The cable 18 is wrapped around the band wheel 3 and presses against the insertion band 4 from the outside. In this way, the band 4 is pressed against the circumference of the band wheel 3. Another guide 19 is provided for the insertion band 4 between the band wheel 3 and the warp shed.

The cable 18 is wrapped around the entire circumference of band wheel 3, and additionally passes over two rollers 20 and 21 which are braced against each other by a spring (not shown). This roller and spring arrangement ensures that the cable 18 presses against the insertion band 4 from the outside with a definite and adjustable initial force.

An arrangement of this type with a guide element in the form of a cable 18 of appropriate length, provided for the purpose of preventing the insertion band 4 from separating from band wheel 3, is described in U.S. Pat. No. 4,274,449. Rollers 20 and 21 (reference numerals from the present drawings) and their mutual arrangement and functioning are alsc described in that patent. Therefore, a more detailed description of rollers 20 and 21 is not deemed to be essential in the present application. Therefore, U.S. Pat. No. 4,274,449 is hereby incorporated by reference.

As also described in U.S. Pat. No. 4,274,449, the cable 18 passes twice around the circumference of the band wheel 3. In the first pass, the cable 18 (reference numerals from the present drawings) presses against the insertion band 4 and in the second pass the cable 18 runs in a guide groove. The transition between the two passes is made by the rollers 20 and 21. With reference to FIG. 1, the cable 18 runs in its first pass clockwise from the end 16 over the insertion band 4 to the roller 21 and then to roller 20. The cable 18 is then returned on the second pass in which the cable extends to the other end 15.

Figure 2:
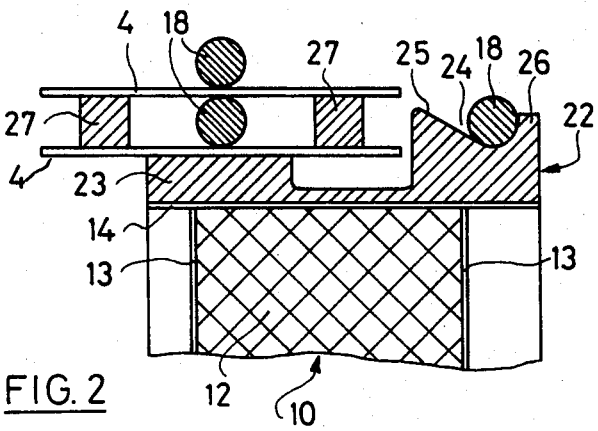
FIGS. 2 and 3 are cross-sectional views through line II—II of FIG. 1, for two different operating states.
Figure 3:
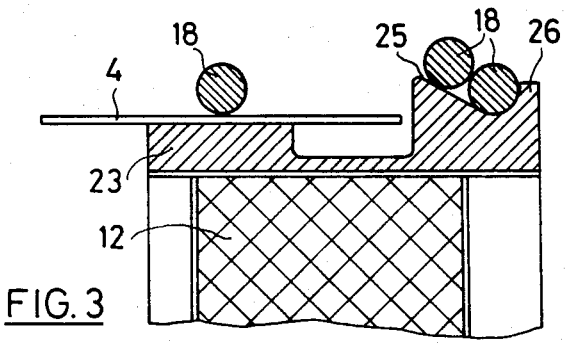

The arrangement of the cable 18 and the insertion band 4 on the band wheel 3 in accordance with the present invention can be seen from FIGS. 2 and 3. Also, the configuration of the band wheel 3 in the region where the cable ends 15 and 16 are anchored can be seen from FIGS. 4–6. FIGS. 2 and 3 are cross-sectional views along the line II–II of FIG. 1, with the sectional view of FIG. 2 corresponding to the rotational position of band wheel 3 indicated in FIG. 1. The sectional view of FIG. 3 corresponds to the rotational position following one full rotation of the band wheel 3 in the clockwise direction.

Figure 5:
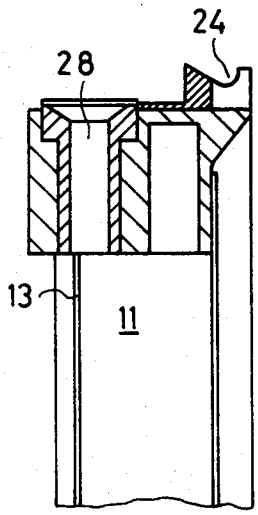
FIG. 5 is a cross-sectional view through line V—V of FIG. 4.
Figure 4:
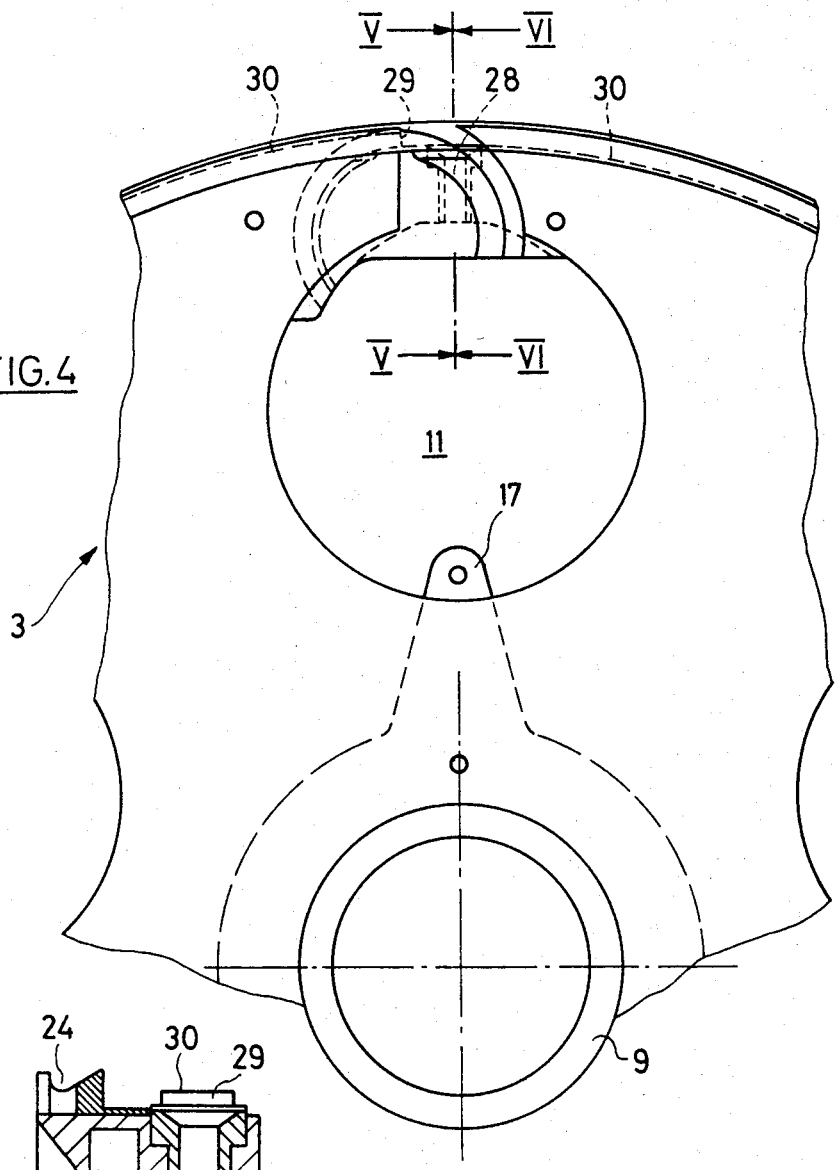
FIG. 4 is a front view partially cutaway of the band wheel of FIG. 2.
Figure 6:
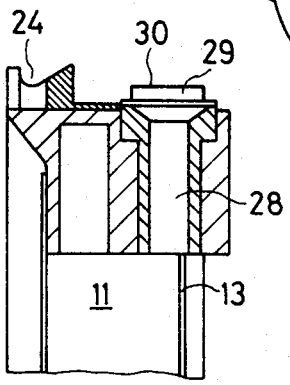
FIG. 6 is a cross-sectional view through line VI—VI of FIG. 4.

FIG. 4 is a cross-sectional view of the band wheel 3 absent the insertion band 4 and the cable 18; FIGS. 5 and 6 are cross-sectional views through the location indicated in FIG. 4 on band wheel 3, viewed respectively from opposite directions.

FIG. 2 corresponds to the rotational position of the band wheel 3 in which the gripper head 5 (FIG. 1) is fully and maximally withdrawn from the warp shed. In this rotational position of the band wheel 3, the insertion band 4 winds around the band wheel 3 about 1 and $\frac{1}{4}$ times circumferentially (about 460°) from the anchor point of the band 4. Thereafter, the band 4 leaves tangentially from the band wheel 3 and runs in the guide 19. In order for the cable 18 to prevent any separation of the insertion band 4 from the circumference of the band wheel 3 during the entire unwinding and winding motion of the band 4, the cable 18 must wind around the band wheel 3 for a length corresponding to the instantaneous wound length of the insertion band 4. In the rotational position of FIGS. 1 and 2, this length is about 460°. With this arrangement, the cable 18 winds around the band wheel 3 in two layers in the first pass over the segment of the circumference on which the insertion band 4 is wound in two layers. This segment corresponds to the overlapped winding length, about 100°.

As can be seen from FIG. 2, the sheet or film 14 on the circumference of the band wheel 3 includes a support element 22. The support element 22 has a shoulder 23 for supporting the insertion band 4 and further has a guide groove 24 for the cable 18. The groove 24 has an inclined interior side 25 on the side nearest the shoulder 23, and a ridge 26 on its other side. The groove 24 is deeper than the radius of the cable 18 and the guide groove 24 serves as a base for the second pass.

Disregarding the fact that the two rollers 20 and 21 are a certain distance apart, and thus disregarding the length of cable 18 around and between the rollers 20 and 21, the length of the cable 18 pressing against the band wheel 3 is about twice the circumference of the band wheel 3. This length is apportioned to the two passes of the cable 18 depending upon the position of the gripper head 5 and thus the rotational position of the band wheel 3.

FIG. 3 corresponds to the rotational position of the band wheel 3 at which position the gripper head 5 (FIG. 1) is maximally extended into the warp shed and at which position the insertion band 4 is nearly completely unwound from the band wheel 3. Also in this position, the band wheel 3 has rotated about 450° clockwise from the position of FIGS. 1 and 2, and the end of the insertion band 4 which end is attached to the band wheel 3 by the screw 6 lies immediately counterclockwise of the roller 20 (FIG. 1).

In this position, the first pass of the cable 18, over the insertion band 4 resting on the shoulder 23, comprises only the short length up to the roller 21 (FIG. 1). In the second pass in the guide groove 24, the cable 18 is in a double layer over the entire circumference of the band wheel 3.

The guide groove 24 and the insertion band 4 are both configured so as to enable the cable 18 to wind around the band wheel 3 in the respective path in a double layer. In this connection, as mentioned, the guide groove 24 is deeper than the radius of the cable, and has the ridge 26 and the inclined side 25 to retain two layers of the cable 18.

With reference to FIGS. 2 and 3, the first layer or pass of the cable 18 runs at the bottom of the guide groove 24 and rests against the ridge 26. As shown in FIG. 3, the second layer or pass settles in on the inclined side 25, to the side of the first layer. Alternatively, the inclined side 25 may be dispensed with and the guide groove may be made deeper than the diameter of the cable 18. In this way, the groove 24 would be bounded on both sides by ridges similar to the ridge 26, and the two layers of the cable 18 would be directly above one another.

The insertion band 4 lies on the shoulder 23 from the screw 6 over 360° of the circumference of the band wheel 3, and the cable 18 lies over the band 4. After one complete circuit of the band wheel 3, the overlap region begins. In the overlap region, the insertion band 4, now in its second layer or pass, lies over the first layer of the cable 18 and is held down by the second layer of the cable 18 (FIG. 2). Since this configuration is relatively unstable, the configuration could lead to the second layer of insertion band 4 tilting or twisting and resting against its edge. Accordingly, the second layer is preferably supplied with two separating strips 27 attached to a portion of the band 4 near its edges and over the extent of the maximum overlap of the second layer on the first, i.e., over approximately a 100° angle in the region adjacent to the screw 6 (clockwise as seen in FIG. 1). These separating strips 27 are made of plastic and are attached to the insertion band 4 by gluing. As shown, the cross section of the strips 27 is rectangular and their height corresponds to the diameter of the cable 18.

According to FIGS. 4 to 6, the band wheel 3 is configured on its circumference which supports the insertion band 4 such that the overlapping of the band 4 is accommodated. Further, the band wheel 3 has a step 29 at a hole 28 which receives the attaching screw 6 (FIG. 1). The height of the step 29 corresponds to the diameter of the cable 18 plus the thickness of the insertion band 4. This height is accomplished by a basically spiral configuration of the circumference of the band wheel 3. Preferably the honeycomb part 12 is circular, and the shoulder 23 of the support element 22, which shoulder supports the insertion band 4, has a thickness which varies suitably along the circumference of the band wheel. In the region of the circumference clockwise from the hole 28 for a distance at least equal to the winding overlap length (about 100°), the shoulder 23 has a constant thickness. Following this region, the thickness increases continuously up to the location of the step 29. The step can be seen in FIG. 4 along with the support surface 30 of the shoulder 23.

The overlapping of the insertion band according to the present invention on the band wheel may be employed in connection with other known guiding arrangements for preventing the insertion band from separating from the circumference of the band wheel. These alternative guiding arrangements do not necessarily involve a cable cut to length.

If the guiding arrangement is in the form of an endless belt or cable, as described in U.S. Pat. No. 4,274,449, it is sufficient for the guiding arrangement to encircle the band wheel only once. In this way, in a region where the insertion band is in two layers, the guide runs over the external layer, and presses on the internal layer through the external layer. In a region where the insertion band is in only one layer, the band is held down directly by the belt or cable.

The principles, preferred embodiment and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. A weft insertion device for use on a band-gripper weaving machine, said device comprising a driven, rotationally oscillating band wheel, a flexible insertion band having a gripper head and executing an oscillating movement into and out of a warp shed as the band unwinds from and winds onto an outer circumference of the band wheel respectively, guide means for preventing the insertion band from separating from the outer circumference of the band wheel, said guide means being a cable cut to an appropriate, fixed length and adapted to press against an outside surface of the insertion band, both ends of the cable being anchored to the band wheel, the circumference of the band wheel being smaller than a maximum excursion of the gripper head, the insertion band being wound around the circumference of the band wheel to the extent of more than 360° when the gripper head is in a position in which the gripper head is fully and maximally withdrawn from the warp shed, the cable pressing against the entire instantaneous length of the insertion band which is wound onto the band wheel, and in a winding overlap region of the insertion band, in which region two layers of the band are wound onto the band wheel, the outer layer of the insertion band rests on a first cable layer which presses against the inner layer of the insertion band, and said outer layer being held by a second cable layer on an outer surface of the outer band layer.

2. The device according to claim 1, wherein the length of the cable which encircles the band wheel is approximately twice the circumference of the band wheel.

3. The device according to claim 1, further comprising spacing means for maintaining separation between the layers of the insertion band, said spacing means extending outwardly and being arranged on an outer side of the insertion band over a segment of the band corresponding to both the location and the length of the winding overlap region.

4. The device according to claim 3, wherein the spacing means comprise two strips running parallel to a longitudinal axis of the insertion band and arranged on either side of the path of the cable, the height of the spacing strips corresponding to the diameter of the cable.

5. The device according to claim 4, wherein the strips are rectangular in cross section and are adhesively fastened to the insertion band.

6. The device according to claim 1, wherein the length of the winding overlap region is greater than 60° of the band wheel circumference.

7. The device according to claim 6, wherein the cable encircles the band wheel in two passes at a distance from each other, said cable being deflected between the two passes by a pair of rollers, one of said passes running along the longitudinal axis of the insertion band and the other pass being arranged in a guide groove for the cable, a support element being provided along the circumference of the band wheel, the support element having a shoulder for supporting the insertion band in the region of one of said passes and having the guide groove for the cable in a region of the other pass.

8. The device according to claim 7, wherein the guide groove has an inclined interior wall on a side nearest the shoulder and a ridge on the other side of the support element, said groove being deeper than the radius of the cable.

9. The device according to claim 8, wherein the radiu of the band wheel increases from an anchoring point of the insertion band in the direction toward the gripper head and around to the anchoring point again, the band wheel having a step in the region of the anchoring point, the height of said step corresponding to the diameter of the cable plus the thickness of the insertion band.

10. The device according to claim 9, wherein the height of the shoulder increases to produce the increase in the radius of the band wheel.

11. The device according to claim 10, wherein the radius of the band wheel on the segment of the band wheel circumference corresponding to the length and location of the winding overlap region and adjoining the anchoring point of the insertion band is constant, and the radius of the band wheel increasing over the remainder of the circumference of the band wheel.

* * * * *